United States Patent [19]

Cowley

[11] 3,978,984

[45] Sept. 7, 1976

[54] DRILL PACK HOLDER

[75] Inventor: William E. Cowley, Louisville, Ky.

[73] Assignee: Vermont American Corporation, Louisville, Ky.

[22] Filed: Feb. 11, 1976

[21] Appl. No.: 657,149

[52] U.S. Cl. ..... 206/379; 206/443; 206/481; 211/69

[51] Int. Cl.[2] ..... B65D 85/20; B65D 85/24

[58] Field of Search ..... 206/379, 372, 373, 380, 206/481, 479, 477, 485, 371, 443; 211/69

[56] References Cited

UNITED STATES PATENTS

| | | | |
|---|---|---|---|
| 689,667 | 12/1901 | Blakeslee | 206/485 |
| 953,930 | 4/1910 | Stockinger | 206/379 |
| 1,726,732 | 9/1929 | Doran | 206/485 |
| 3,236,366 | 2/1966 | Broda et al. | 211/69 |
| 3,749,233 | 7/1973 | McCormick, Jr. | 206/373 |

*Primary Examiner*—William T. Dixson, Jr.
*Attorney, Agent, or Firm*—Johnson, Dienner, Emrich & Wagner

[57] ABSTRACT

A unitary holder for a set of masonry drills, or twist drills generally, provides a main vertical plastic back plate upon the front of which are mounted in parallel open ended cylindrical loops of selected sizes for holding drills or other articles in parallel assembly with their shanks disposed in pockets in line with the loops. The pockets receive the shank ends of the drills and hold the drills with their cutting ends on a common level. The loops hold the intermediate parts of the drills. A transverse horizontal cover flange integral with the back plate extends across the plate at right angles thereto a short distance above the loops. An extension of the back plate above the horizontal flange holds all the drills separately—endwise and sidewise—with minimal play. The main sheet which forms the plastic back is flexible in the region between the flange and the upper edge of the row of loops. The pockets which receive the shank ends of the drills are located at positons which bring the tops of all of the drills up to the level of the transverse flange, even though they differ in length and diameter. The sheet in the region above the loops and below the flangs constitutes a flexible connection which acts like a spring hinge. It alows the extension of the main sheet above the flange to act as a lever to raise and swing aside the flange from above the drills thereby exposing the drills to easy extraction from their mounting on the main sheet and for replacement of the same.

4 Claims, 4 Drawing Figures

DRILL PACK HOLDER

THE PROBLEM

Many workmen, particularly service and repair men, require in their kit of tools a set of twist drills for drilling metal or for drilling masonry as in the specific form of the invention herein disclosed. Customarily, these sets of drills comprise a pack of graduated diameters required to maintain a full set of drills in a manner of display which allows the user to effect a ready selection from a group of drills of graduated sizes. This problem has been repeatedly attacked by the production of drill packages of various forms, leaving much room for improvement. If the package provides for ready inspection to determine which is the size required, or to determine the proper replacement position in the holder, there is difficulty in extracting and in replacing the drills, particularly in the smaller drills from or to the package, and difficulty in properly replacing them and retaining them in such positions. Solution of the problem requires a package which will hold the drills securely in their proper places in the group, which must be clearly open for inspection and selection; it must hold the drills securely in the package or container; and it must expose the drills in the package with marking of the size, with easy replacement and firm retention of the individual drills in their proper places.

SUMMARY OF THE INVENTION

The present invention provides a container for a set of twist drills, or similar articles, mounted in a plastic holder which holds the drills individually in pockets at their shank ends, in loops at their intermediate portions adjacent the cutting ends, with the cutting ends all brought into line and held in place under a cross or transverse point protecting flange utilizing a flexible section of the main plate between the row of loops and the retaining flange to operate as a straight line hinge transverse to the longitudinal axes of the drills whereby folding back the extended upper part of the back plate swings the retaining flange out of the line of the packaged drills for easy grasping with the thumb and finger and removal of the selected drill from the holder. Replacement of the drills is effected by bending back the upper part of the back plate and inserting the drills into their respective positions and allowing the top of the back plate to swing into alignment with the remainder of the holder automatically.

BRIEF DESCRIPTION OF THE DRAWINGS

In the accompanying drawings

DETAILED DESCRIPTION

Figure 1:
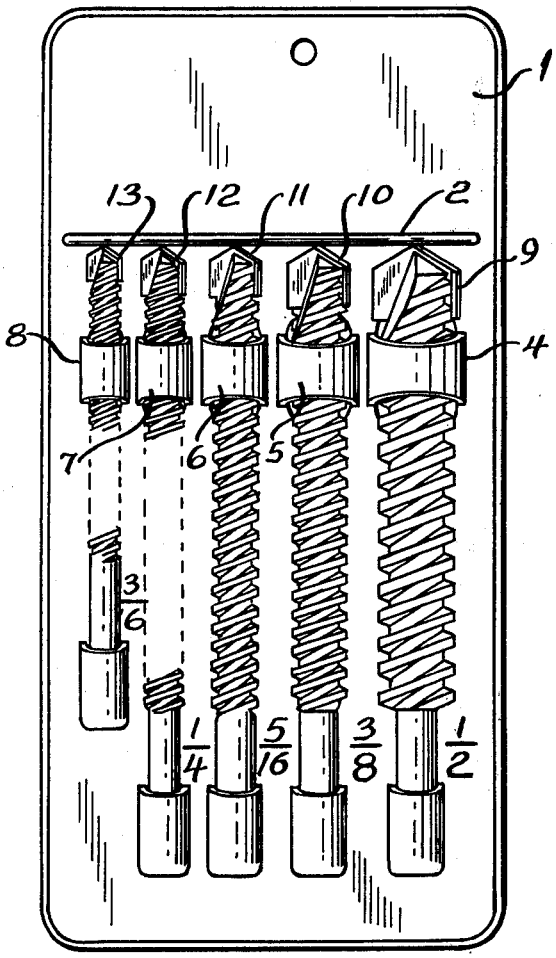
FIG. 1 is a front elevation of the package of drills embodying my invention.
Figure 2:
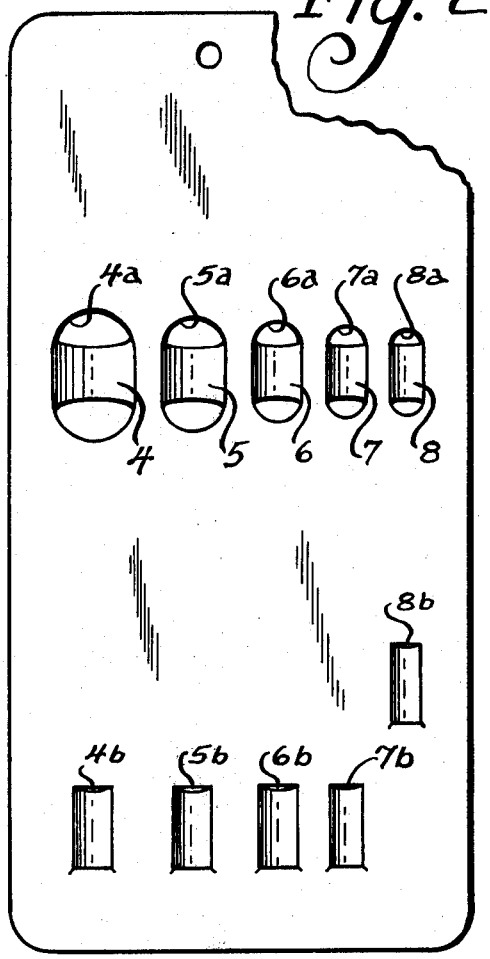
FIG. 2 is a rear elevation of the holder shown in FIG. 1, with the drills removed from the holder.

The drill holder of my invention comprises a thin but relatively stiff and resilient back plate 1 of molded plastic constituting one single piece. The back plate which normally lies in a plane, but may be flexed as shown in FIG. 4, has on its front face a horizontal flange 2 which is at right angles to the back plate 1, as may be seen in FIG. 3. A series of loops 4, 5, 6, 7 and 8 of sizes—that is, diameters—correspond to the masonry drills 9, 10, 11, 12 and 13. The lower ends of these drills may terminate at different levels. In the specific example herein illustrated, the smallest drill 13 is of a length less than the other drills in the group. The length and diameters of the drills to be packaged according to my invention may be greater or less than the particular embodiment which I have here employed for illustrative purposes. The shanks of the drills may be of the same or different diameters.

The upper ends of the drills are circumferentially hold in the loops 4, 5, 6, 7 and 8 which are formed integral with the base plate 1 and in each case the drill extends over a corresponding open window 4*a*, 5*a*, 6*a*, 7*a* and 8*a*. Similarly, the lower ends of the drills are exposed through windows in the base plate 4*b*, 5*b*, 6*b*, 7*b* and 8*b*. These openings reveal the character of the drill which is visible through the corresponding opening and at the same time avoid use of idle material in the makeup of the articles and provide a method of supporting the core of the mold for forming the pockets 4*b*-7*b*.

The drills illustrated in the present drawings are masonry drills for drilling rock, cement or the like; however, metal cutting drills may be packaged equally well according to the present invention. In the exemplary showing herein, the shanks are of graduated sizes corresponding to the size of the cutting bits. The pockets 4*b*-8*b* and the loops or straps 4*a*-8*a* are graduated to the corresponding drill diameters.

Indications of the diameters of the drills, as shown in FIG. 1, may be molded upon the front face of the main plate 1. This is preferably located adjacent the shank end of the particular drill so marked.

The bottom cups or holders of the lower ends of the drills are so located vertically as to bring the cutting bit ends into transverse alignment with each other under the transverse flange 2. Thereby, the individual drills in the package are closely held endwise as well as laterally. The plastic material of which the holder is molded is elastic within a wide range of displacement. It permits that part of the main sheet lying between the transverse flange or wall 2, and the upper loops 4, 5, 6, 7 and 8, to serve as a self-straightening hinge with maximum deflection on the transverse band of weakness to bending formed at the upper rounded ends of the openings 4*a*-8*a*, whereby the drills may be revealed endwise for their entire cross section and to be easily grasped by the finger and thumb of the user and pulled out of the holder—that is, out of the loops at the upper end and out of the cups at the lower end.

Figure 3:
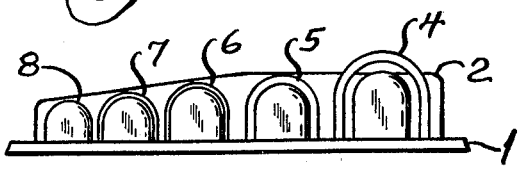
FIG. 3 is an end elevation taken from the bottom of FIG. 1.
Figure 4:
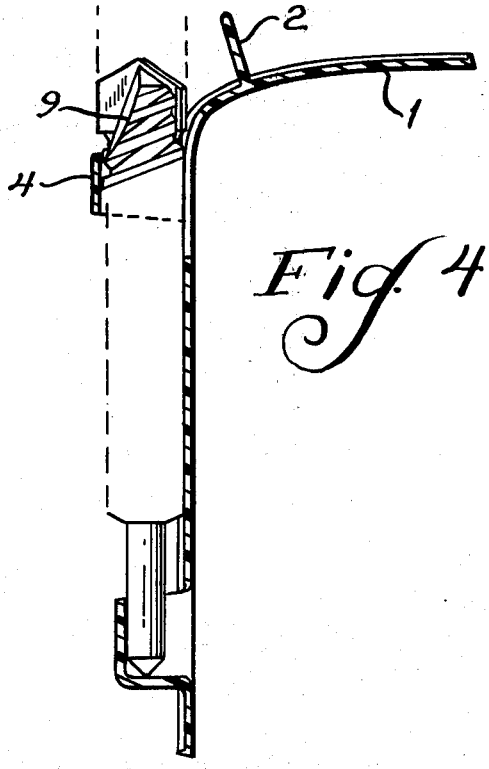
FIG. 4 is a vertical section taken on the line 4—4 of FIG. 1 looking in the direction of the arrows and showing the upper part of the base plate bent back in nonobstructing position revealing the tops of all of the drills in the package.

The most flexible portion of the plate 1 lies between the transverse wall or flange 2, and the tops of the openings 4*a*-8*a* have the function of serving as a spring hinge, which is self-restoring, to be bent back to clear the upper ends of the drills as shown in FIG. 4 and to restore itself automatically into blocking position to keep the drills securely held endwise as well as sidewise, as illustrated in FIG. 3.

The cross sectional area of the plate 1 is a minimum at the upper rounded end portions of the slots 4*a*-8*a* just above the loops 4, 5, 6, 7 and under the flange 2. The consequence is that the plate 1 bends most easily along that line and removes the transverse wall 2 away from the line of endwise motion of withdrawal of the drills and also for return of the drills to their loops and pockets. The additional advantage of the above described structure is that the arrangement allows the finger of the operator to enter between the drill and the main plate 1 for convenient removal and for replacement of each drill in its loop 4-8 and pockets 4*b*-7*b* respectively, and the main plate, when released, recoils and brings the horizontal flange 2 back over the tops of the drills automatically.

The sizes and lengths of the drills so packaged may vary widely within the invention. The hinge portion between the flange or transverse wall 2 is automatically restored to its folding position over the ends of the drills. The end of the base plate 1 above the flange or holding wall 2 is substantially imperforate and hence relatively inflexible. Flexibility in this region may be controlled by varying the lengths, vertically, of the slots 4*a*-8*a*. The desired effect is to have a self-restoring hinge made of the same material as the rest of the holder which is all one piece, but with the physical characteristics—more particularly, flexibility—at selected locations being governed by physical dimensions to give the desired characteristics, such as flexibility at one part and stiffness an another. The ability of the device to get all obstruction out of the line of insertion and withdrawal of the drills, with self-closure to hold the drills in close or unrestrained position and yet allow room for the fingers of the operator to secure grasp of the upper ends of the drills, is unique. The invention is applicable to metal cutting drills, as well as to the masonry drills illustrated in the drawings and described above. The important contributions here include the ease of removing and/or replacing of the selected drill, the self-closing character of the holder, and the accessability to visual inspection endwise as well as sidewise.

In contrast to prior attempts to package drills wherein the cutting ends of the drills are disposed in the package on an inclined diagonal line instead of on a horizontal line, as in the present case, the clearance between the endwise restraining means and the point of the drill is so restricted that the fingers of the operator find difficulty in gaining access to any single small drill. The present invention obviates that difficulty.

I claim:

1. A holder for drills comprising a main planar sheet of tough flexible molded plastic having a front face and a back face, a thin transverse integral flange extending across the upper part of the front face of said sheet and lying at right angles to the plane of the main sheet, a series of parallel, vertically extending loops of graduated diameters corresponding to the sizes of the drills to be held thereby, and extending side-by-side in a row transverse to the longitudinal axis of the main sheet and being disposed a short distance below said flange, said loops being of graduated diameter for receiving and holding drills of corresponding diameters and lengths to fit with sliding clearance between the drills and the loops, the drills to be held thereby, said plate having pockets open at their upper ends toward the loops and being closed at their lower ends for receiving and holding with sliding clearance the lower ends of the articles to be mounted, the pockets being disposed at levels suitable for supporting the shanks of the drills with their upper ends substantially in a straight transverse line immediately below the aforesaid flange, the base plate extending upwardly above the flange a distance great enough to provide leverage for bending the base plate, in the region between said flange and said loops, to expose the upper ends of the supported drills for convenient grasping by the thumb and finger of the operator, said flexed portion of the back being resilient and when released springing back into substantially the plane of the sheet below the loops.

2. The combination of claim 1 wherein the back plate has slots in register with the loops for concentrating the binding stress in the part of the back plate between the loops and the flange.

3. The combination of claim 2 wherein the ends of the loops are attached to the back plate between the edges of the adjacent loops to limit concentration of bending stresses of the back plate in the region of said perforations when the top of the sheet is bent back to reveal the upper ends of the drills.

4. The combination of claim 1 wherein the loops are separately arched over corresponding slots and have their ends formed integral with the edges of the slots whereby bending back the upper part of the main sheet does not pinch the drills contained in the loops.

* * * * *